US008032962B1

(12) United States Patent
Payne

(10) Patent No.: US 8,032,962 B1
(45) Date of Patent: Oct. 11, 2011

(54) SHOE ENLARGEMENT DEVICE

(76) Inventor: Felicia Monica Payne, Columbia, SC (US)

( * ) Notice: Subject to any disclaimer, the term of this patent is extended or adjusted under 35 U.S.C. 154(b) by 546 days.

(21) Appl. No.: 12/253,210

(22) Filed: Oct. 16, 2008

(51) Int. Cl.
*A43D 5/00* (2006.01)

(52) U.S. Cl. ..... 12/116.6; 12/115.8; 12/116.8; 12/117.4

(58) Field of Classification Search ..... 12/116.6, 12/116.8, 117.4, 115.8, 115.6, 116.4, 117.2
See application file for complete search history.

(56) References Cited

U.S. PATENT DOCUMENTS 2,295,359 A * 9/1942 Schiller ..... 12/117.4
2,443,792 A * 6/1948 King ..... 12/116.2
2,473,229 A * 6/1949 Van Beurden ..... 12/116.2
2,549,502 A 4/1951 McClenathan
2,570,552 A * 10/1951 Hawkins ..... 12/116.4
2,634,439 A * 4/1953 Fitzpatrick ..... 12/116.2
3,068,502 A * 12/1962 Williams ..... 12/116.6
3,263,252 A * 8/1966 Johnson ..... 12/116.6
3,823,433 A 7/1974 Smith
3,986,221 A * 10/1976 Thompson ..... 12/114.8
4,069,531 A * 1/1978 Streich ..... 12/116.2
4,512,052 A * 4/1985 Bruno ..... 12/116.2
D331,828 S 12/1992 Issler
D338,323 S 8/1993 Bramble
5,875,504 A 3/1999 Tambling

* cited by examiner

*Primary Examiner* — Ted Kavanaugh

(57) ABSTRACT

The present invention features a shoe enlargement device for stretching a user's shoe comprising an expansion device having a toe piece and a heel piece. The toe piece is connected to the heel piece via an enlargement screw, wherein turning the enlargement screw moves them closer together or farther apart. The first half of the toe piece and the second half of the toe piece can be moved closer together or farther apart via an anchor piece, a first roller bar, and a second roller bar.

1 Claim, 5 Drawing Sheets

SHOE ENLARGEMENT DEVICE

FIELD OF THE INVENTION

The present invention is directed to a device for enlarging a shoe.

BACKGROUND OF THE INVENTION

The present invention features a shoe enlargement device for stretching a user's shoe to accommodate his/her foot more comfortably. The shoe enlargement device comprises a generally foot-shaped expansion device having a toe piece and a heel piece, wherein the toe piece comprises a first half and a left half separated by a cavity. The toe piece is removably attached to the heel piece via an enlargement screw, wherein the enlargement screw extends outward from the heel piece and screws into an anchor piece disposed in the cavity of the toe piece. The enlargement screw allows the toe piece and the heel piece to be separated. A user can turn the enlargement screw to move the toe piece and the heel piece either closer together or farther apart, depending on how much he/she wishes to stretch his/her shoe.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
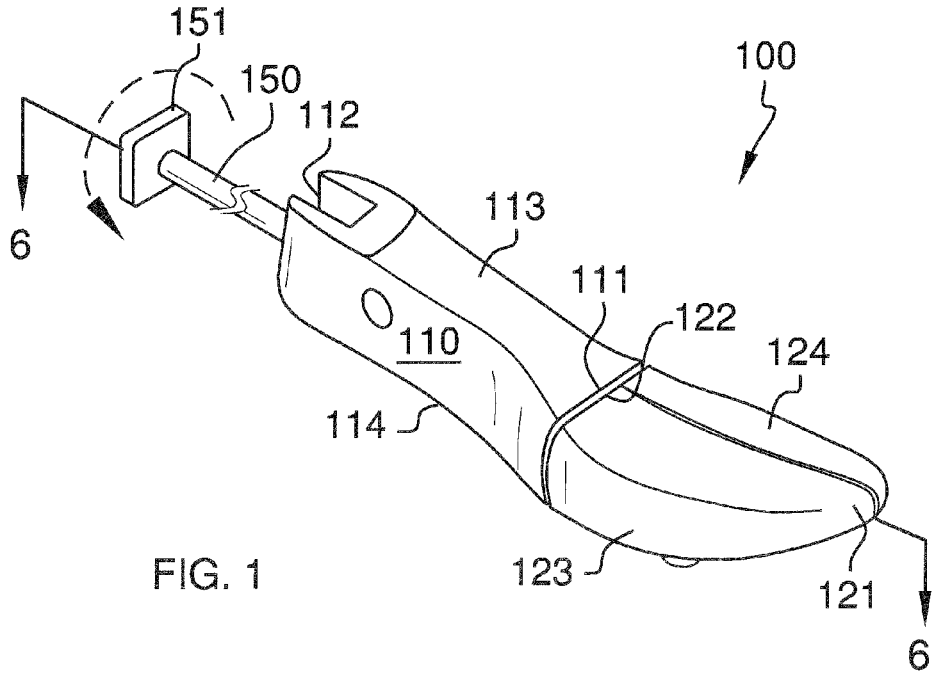
FIG. 1 is a perspective view of the shoe enlargement device of the present invention.

The following is a listing of numbers corresponding to a particular element refer to herein:

100 shoe enlargement device
110 heel piece
111 first end of heel piece
112 second end of heel piece
113 top surface of heel piece
114 bottom surface of heel piece
120 toe piece

Figure 2:
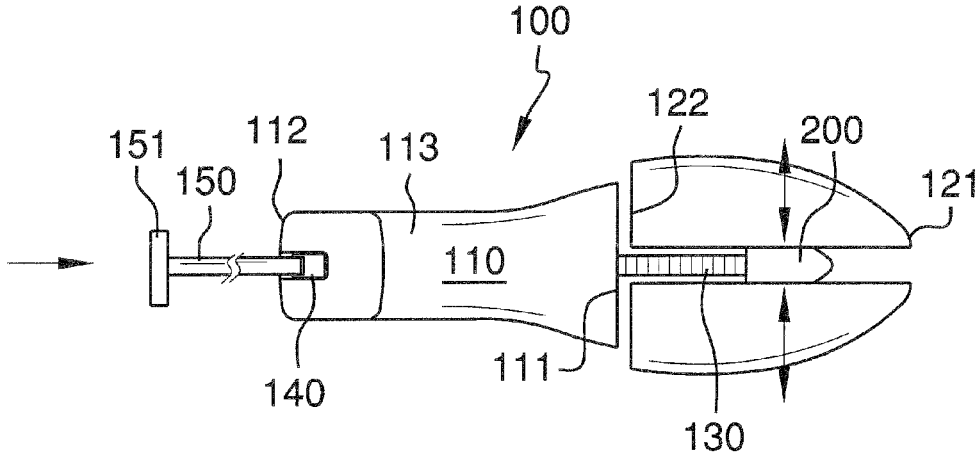
FIG. 2 is a top view of the shoe enlargement device of FIG. 1.
Figure 3:
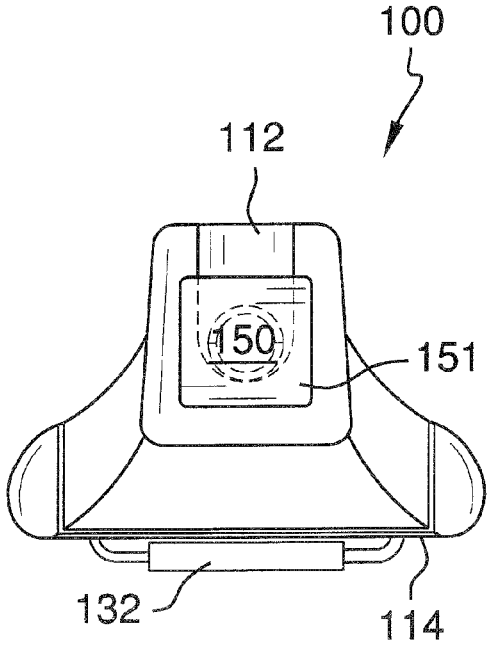
FIG. 3 is a back view of the shoe enlargement device of FIG. 1.
Figure 4:
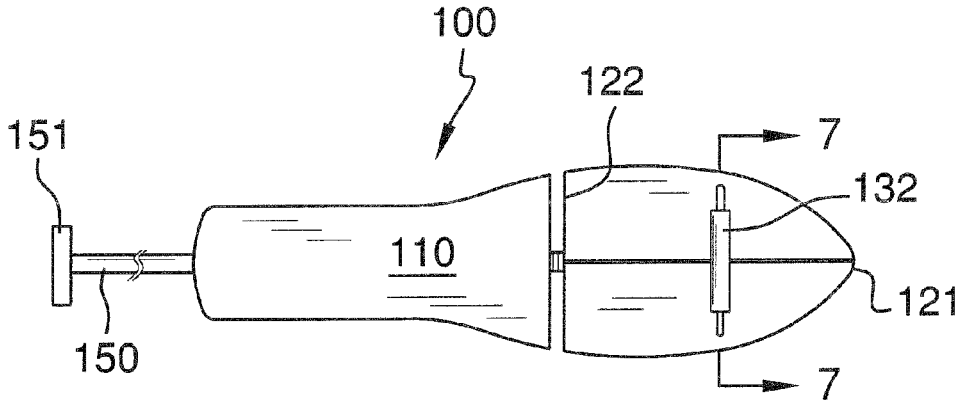
FIG. 4 is a bottom view of the shoe enlargement device of FIG. 1.
Figure 5:
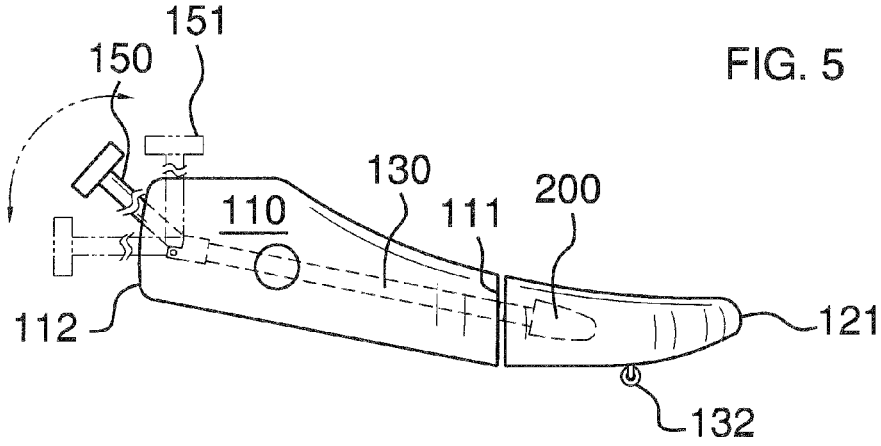
FIG. 5 is a side view of the shoe enlargement device of FIG. 1.
Figure 6:
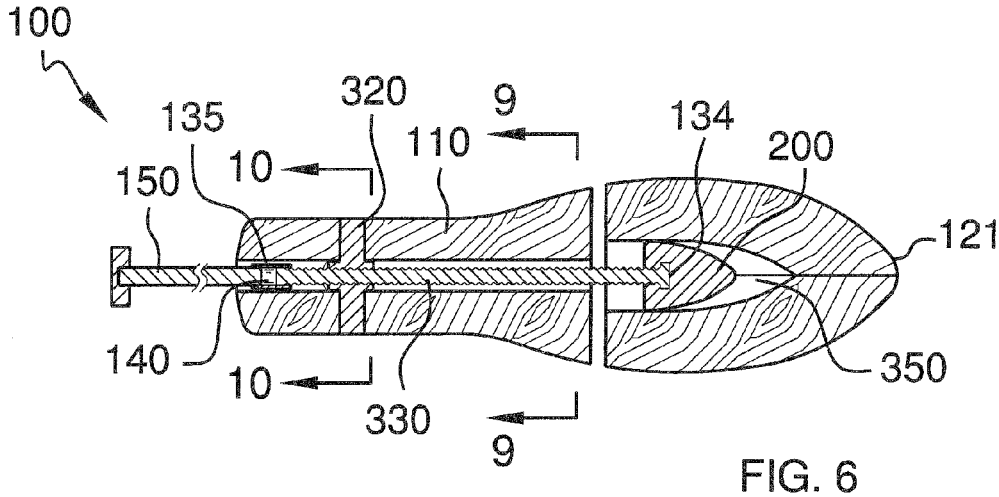
FIG. 6 is a top view and cross-sectional view of the shoe enlargement device of FIG. 1.
Figure 7:
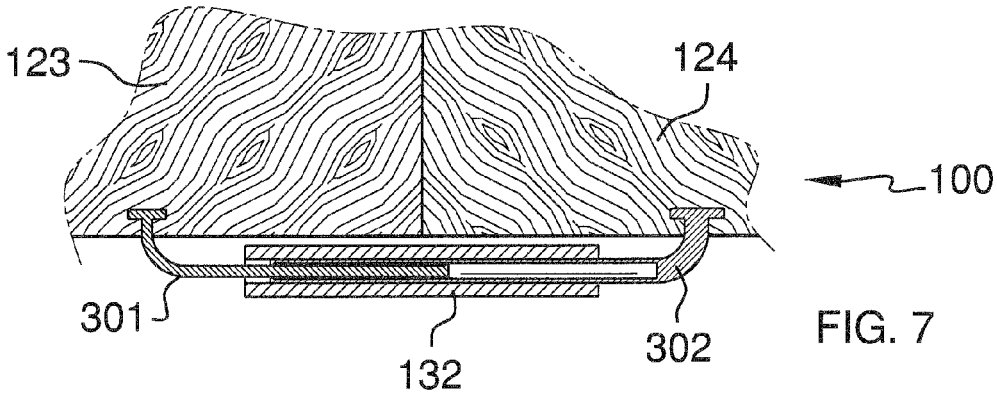
FIG. 7 is a front view and cross-sectional view of the shoe enlargement device of FIG. 1.
Figure 8:
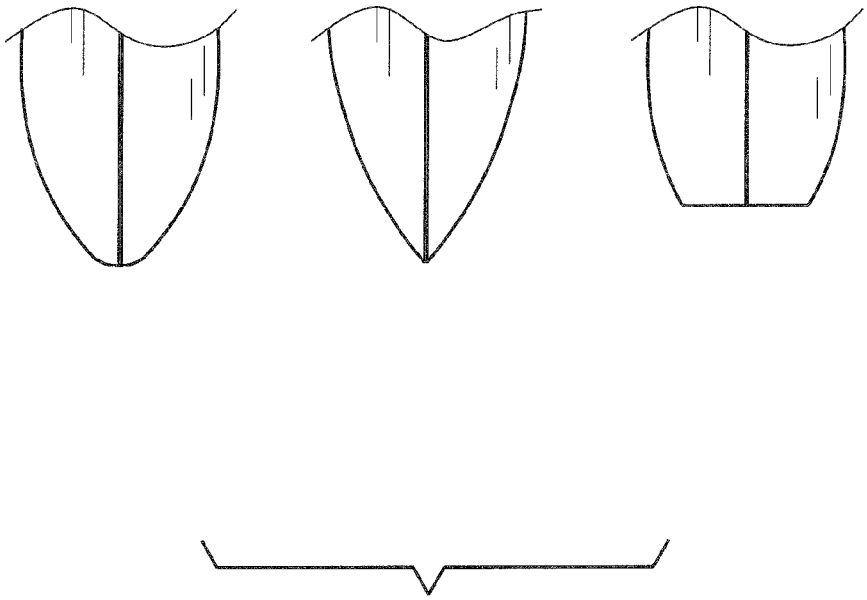
FIG. 8 is a top view of various toe pieces of the shoe enlargement device of the present invention.
Figure 9:
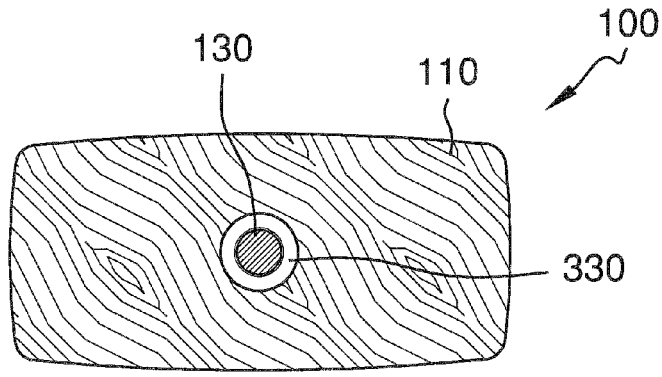
FIG. 9 is a front cross sectional view of the shoe enlargement device of the present invention.
Figure 10:
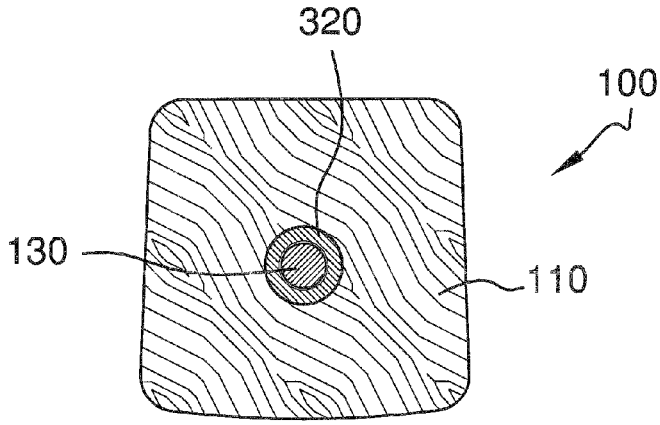
FIG. 10 is a front cross sectional view of the shoe enlargement device of the present invention.

121 first end of toe piece
122 second end of toe piece
123 first half of toe piece
124 second half of toe piece
130 enlargement screw
132 roller
133 roller bar
134 first end of enlargement screw
135 second end of enlargement screw
140 hinge mechanism
150 handle
151 first end of handle
200 anchor piece
301 first roller bar
302 second roller bar
320 gripping piece
330 channel
350 cavity Referring now to FIGS. 1-10, the present invention features a shoe enlargement device for stretching a user's shoe to accommodate his/her foot more comfortably. The shoe enlargement device comprises a generally foot-shaped expansion device having a toe piece and a heel piece. The toe piece has a first end, a second end, a top surface, and a bottom surface, and the toe piece is divided into a first half and a second half separated by a cavity. The cavity is narrower towards the front end of the shoe and is wider towards the heel end of the shoe. The heel piece has a first end, a second end, a top surface, and a bottom surface. An anchor piece disposed in the cavity of the toe piece, wherein the anchor piece is for separating (widening the space between) the first half of the toe piece and the second half of the toe piece. For example, as the anchor piece is pushed towards the narrower end of the cavity, the anchor piece cause the first half and second half to separate further to accommodate the presence of the anchor piece.

The shoe enlargement device further comprises an enlargement screw for removably connecting the first end of the heel piece to the second end of the toe piece. The enlargement screw has a first end, a second end, and threads. The first end of the enlargement screw is attached to the anchor piece disposed in the toe piece. The enlargement screw spans the length of the heel piece as measured from the first end to the second end. The enlargement screw is disposed in a channel having a first end and a second end inside the heel piece. The second end of the enlargement screw extends outwardly from the second end of the heel piece. A gripping piece is disposed in the heel piece near the second end of the channel. The gripping piece engages the threads of the enlargement as it is turned.

The enlargement screw allows the toe piece and the heel piece to be separated by a distance of the user's choice. When the shoe enlargement device of the present invention is inserted into a shoe, the user can turn the enlargement screw to move the toe piece and the heel piece either closer together or farther apart, depending on how much he/she wishes to stretch his/her shoe. In some embodiments, the enlargement screw is turned clockwise and the heel piece moves closer to the toe piece. In some embodiments, the enlargement screw is turned counterclockwise and the heel piece moves farther away from the toe piece.

A handle having a first end and a second end is pivotally attached to the second end of the enlargement screw via a hinge mechanism. The handle allows a user to turn the enlargement screw.

The shoe enlargement device further comprises a first roller bar having a first end and a second end, wherein the first end is attached to the first half of the toe piece on the bottom surface. The second end of the first roller bar is telescopically received in a second roller bar having a first end and a second end. The second end of the second roller bar is attached to the second half of the toe piece on the bottom surface. The first roller bar and second roller bar allow the first half of the toe piece and the second half of the toe piece to be moved closer together or farther apart.

A roller surrounds the first roller bar and second roller bar. The roller is for preventing damage to a sole of the shoe when the shoe expansion device is inserted or expanded in the shoe. In some embodiments, the roller can allow the toe piece to move father into the shoe when the shoe enlargement device is inserted into the shoe or when the heel piece and toe piece are moved farther apart.

A user can turn the enlargement screw via the handle to move the toe piece and the heel piece either closer together or farther apart and to move the anchor piece in the cavity of the toe piece. In some embodiments, moving the anchor piece in the cavity of the toe piece can push the first half of the toe piece and the second half of the toe piece farther apart.

The shoe enlargement device of the present invention may be constructed from a variety of materials. For example, in some embodiments, the shoe enlargement device is constructed from a material comprising a plastic, a wood, a metal, the like, or a combination thereof.

The shoe enlargement device of the present invention may be constructed in a variety of sizes. For example, in some embodiments, the shoe enlargement device is constructed to fit into a U.S. size 7 women's shoe, a U.S. size 9 women's shoe, a child's shoe, a size 9 men's shoe, a size 10 men's shoe, the like, or a combination thereof.

The following the disclosures of the following U.S. patents are incorporated in their entirety by reference herein: U.S. Pat. No. 3,986,221; U.S. Pat. No. 2,549,502; U.S. Pat. No. 4,069,531; U.S. Pat. No. 5,875,504; U.S. Pat. No. 3,823,433.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A shoe enlargement device for stretching a user's shoe to accommodate his/her foot more comfortably, said shoe enlargement device comprising:

(a) a generally foot-shaped expansion device having a toe piece and a heel piece; wherein the toe piece has a first end, a second end, a top surface, and a bottom surface, wherein the toe piece is divided into a first half and a second half separated by a cavity; wherein the heel piece has a first end, a second end, a top surface, and a bottom surface;

(b) an anchor piece disposed in the cavity of the toe piece; wherein the anchor piece is for separating the first half of the toe piece and the second half;

(c) a channel disposed inside the heel piece, wherein the channel spans the length of the heel piece as measured from the first end of the heel piece to the second end of the heel piece;

(d) an enlargement screw having a first end, a second end, and threads; wherein the enlargement screw is disposed in the channel in the heel piece and spans the length of the heel piece as measured from the first end of the heel piece to the second end of the heel piece; wherein the first end of the enlargement screw is attached to the anchor piece disposed in the toe piece and the second end of the enlargement screw extends outwardly from the second end of the heel piece; wherein the enlargement screw allows the toe piece and the heel piece to be separated by a distance of the user's choice;

(e) a gripping piece disposed in the heel piece near the second end of the channel, wherein the gripping piece engages the threads of the enlargement screw as it turns;

(f) a handle pivotally attached to the second end of the enlargement screw via a hinge mechanism, wherein the handle is for allowing a user to turn the enlargement screw; and (g) a first roller bar having a first end and a second end, wherein the first end is attached to the first half of the toe piece on the bottom surface; wherein the second end of the first roller bar is telescopically received in a second roller bar having a first end and a second end, said second end of said second roller bar attached to the second half of the toe piece on the bottom surface; wherein the first roller bar and second roller bar allow the first half of the toe piece and the second half of the toe piece to be moved closer together or farther apart; and (h) a roller surrounding the first roller bar and second roller bar; wherein the roller is for preventing damage to a sole of the shoe when the shoe expansion device is inserted or expanded in the shoe;

wherein a user can turn the enlargement screw in the gripping piece via the handle to move the toe piece and the heel piece either closer together or farther apart and to move the anchor piece in the cavity of the toe piece; wherein moving the anchor piece in the cavity of the toe piece can push the first half of the toe piece and the second half of the toe piece farther apart.

* * * * *